US005553363A

United States Patent [19]

Chen

[11] Patent Number: 5,553,363

[45] Date of Patent: Sep. 10, 1996

[54] PAPER CLIP SAFETY PIN

[76] Inventor: Kelvin K. Chen, 17012 Royal View Rd., Hacienda Heights, Calif. 91745

[21] Appl. No.: 503,275

[22] Filed: Jul. 17, 1995

[51] Int. Cl.[6] ..... A44B 21/00

[52] U.S. Cl. ..... 24/353; 24/355; 24/707.7; 24/67.9

[58] Field of Search ..... 24/353, 340, 335, 24/331, 355, 351, 707.7, 708.8, 67.7, 67.9, 67.11

[56] References Cited

U.S. PATENT DOCUMENTS

| | | | |
|---|---|---|---|
| 74,301 | 2/1868 | Candee | 24/707.7 |
| 809,691 | 1/1906 | Jacoby | 24/353 |
| 2,013,952 | 9/1935 | George | 24/353 |
| 2,074,359 | 3/1937 | Blake | 24/353 |
| 2,455,968 | 12/1948 | Baker | 24/353 |
| 3,281,908 | 11/1966 | Ross | 24/353 |
| 4,903,379 | 2/1990 | Uchtman | 24/67.7 |

*Primary Examiner*—Victor N. Sakran

[57] ABSTRACT

A pin for securing objects together by piercing or frictional engagement. The inventive device includes a safety pin having an end cap and a pivoting member releasable therefrom which can be piercingly engaged to an object. A paper clip extends from the end cap and cooperates with the safety pin so as to frictionally engage and retain planar objects therebetween.

6 Claims, 3 Drawing Sheets

PAPER CLIP SAFETY PIN

BACKGROUND OF THE INVENTION

1. Field of the Invention

The present invention relates to securing devices and more particularly pertains to a paper clip safety pin for securing objects together by piercing or frictional engagement.

2. Description of the Prior Art

The use of securing devices is known in the prior art. More specifically, securing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art securing devices include U.S. Pat. No. 4,244,085; U.S. Pat. No. 4,903,379; U.S. Pat. No. 4,412,368; U.S. Pat. No. 4,030,166; U.S. Pat. No. 3,883,930; and U.S. Design Pat. No. 258,996.

While these devices fulfill their respective, particular objectives and requirements, the aforementioned patents do not disclose a paper clip safety pin for securing objects together by piercing or frictional engagement which includes a safety pin having an end cap and a pivoting member releasable therefrom which can be piercingly engaged to an object, and a paper clip extending from the end cap and cooperating with the safety pin so as to frictionally engage and retain planar objects therebetween.

In these respects, the paper clip safety pin according to the present invention substantially departs from the conventional concepts and designs of the prior art, and in so doing provides an apparatus primarily developed for the purpose of securing objects together by piercing or frictional engagement.

SUMMARY OF THE INVENTION

In view of the foregoing disadvantages inherent in the known types of securing devices now present in the prior art, the present invention provides a new paper clip safety pin construction wherein the same can be utilized for securing objects together by piercing or frictional engagement. As such, the general purpose of the present invention, which will be described subsequently in greater detail, is to provide a new paper clip safety pin apparatus and method which has many of the advantages of the securing devices mentioned heretofore and many novel features that result in a paper clip safety pin which is not anticipated, rendered obvious, suggested, or even implied by any of the prior art securing devices, either alone or in any combination thereof.

To attain this, the present invention generally comprises a pin for securing objects together by piercing or frictional engagement. The inventive device includes a safety pin having an end cap and a pivoting member releasable therefrom which can be piercingly engaged to an object. A paper clip extends from the end cap and cooperates with the safety pin so as to frictionally engage and retain planar objects therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paper clip safety pin apparatus and method which has many of the advantages of the securing devices mentioned heretofore and many novel features that result in a paper clip safety pin which is not anticipated, rendered obvious, suggested, or even implied by any of the prior art tool guides, either alone or in any combination thereof.

It is another object of the present invention to provide a new paper clip safety pin which may be easily and efficiently manufactured and marketed.

It is a further object of the present invention to provide a new paper clip safety pin which is of a durable and reliable construction.

An even further object of the present invention is to provide a new paper clip safety pin which is susceptible of a low cost of manufacture with regard to both materials and labor, and which accordingly is then susceptible of low prices of sale to the consuming public, thereby making such paper clip safety pins economically available to the buying public.

Still yet another object of the present invention is to provide a new paper clip safety pin which provides in the apparatuses and methods of the prior art some of the advantages thereof, while simultaneously overcoming some of the disadvantages normally associated therewith.

Still another object of the present invention is to provide a new paper clip safety pin for securing objects together by piercing or frictional engagement.

Yet another object of the present invention is to provide a new paper clip safety pin which includes a safety pin having an end cap and a pivoting member releasable therefrom which can be piercingly engaged to an object, and a paper clip extending from the end cap and cooperating with the safety pin so as to frictionally engage and retain planar objects therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
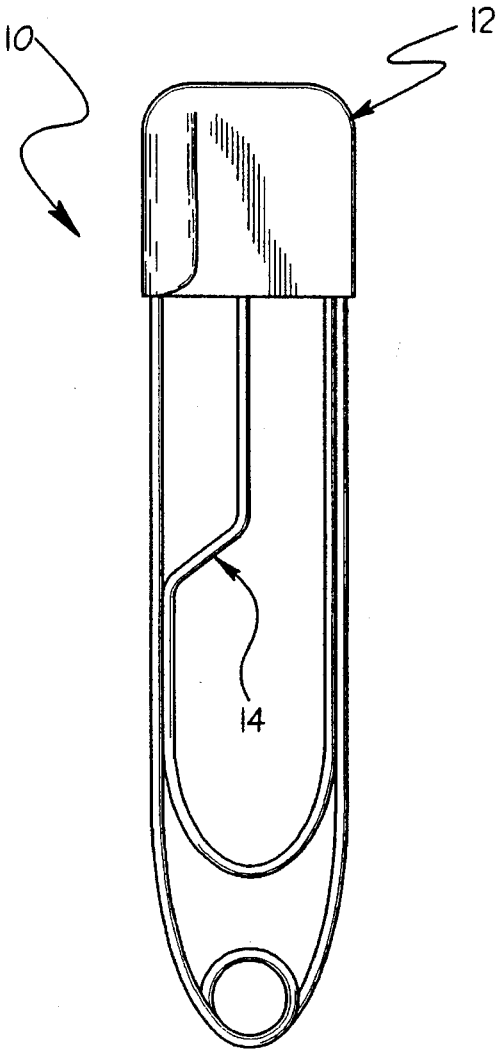
FIG. 1 front elevation view of a paper clip safety pin according to the present invention.

With reference now to the drawings, and in particular to FIGS. 1–6 thereof, a new paper clip safety pin embodying the principles and concepts of the present invention and generally designated by the reference numeral 10 will be described.

More specifically, it will be noted that the paper clip safety pin 10 comprises a safety pin member 12 for piercingly engaging a plurality of objects so as to secure the objects together. A paper clip 14 extends from the safety pin member 12 and cooperates therewith so as to frictionally engage and retain a plurality of planar objects between the paper clip 14 and a portion of the safety pin member 12. By this structure, the present invention 10 can be utilized to couple a plurality of objects together by either a piercing engagement or a frictional engagement therebetween, as desired by an end user.

Figure 2:
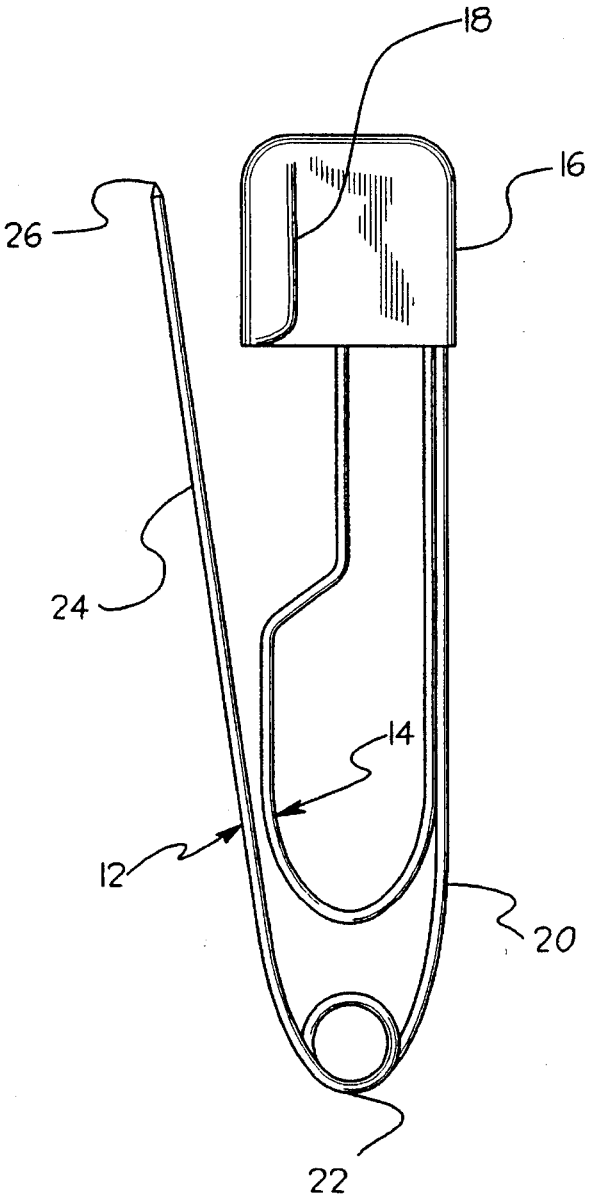
FIG. 2 is a front elevation view of the safety pin in an open position.

As best illustrated in FIGS. 1 and 2, it can be shown that the safety pin member 12 of the present invention 10 preferably comprises an end cap 16 having a receiving slot 18 directed thereinto. A fixed member 20 extends from the end cap 16 and continues into a spring 22. A pivoting member 24 extends from the spring 22 and is biased thereby into the open position illustrated in FIG. 2 of the drawings. The pivoting member 24 is shaped so as to define a piercing tip 26 which can be piercingly engaged to one or more objects during use of the device 10. The pivoting member 24 can thus be biased into the receiving slot 18 of the end cap 16 against a force of the spring 22 to secure such pierced objects relative to the pivoting member 24.

Figure 3:
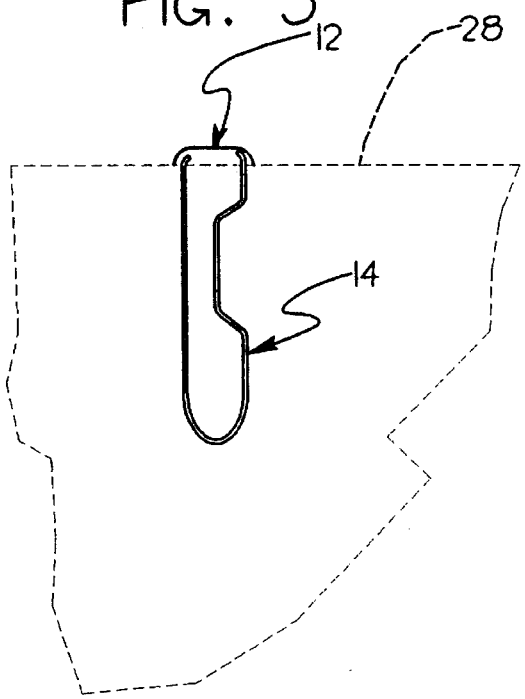
FIG. 3 is a rear elevation view of the present invention in use.
Figure 4:
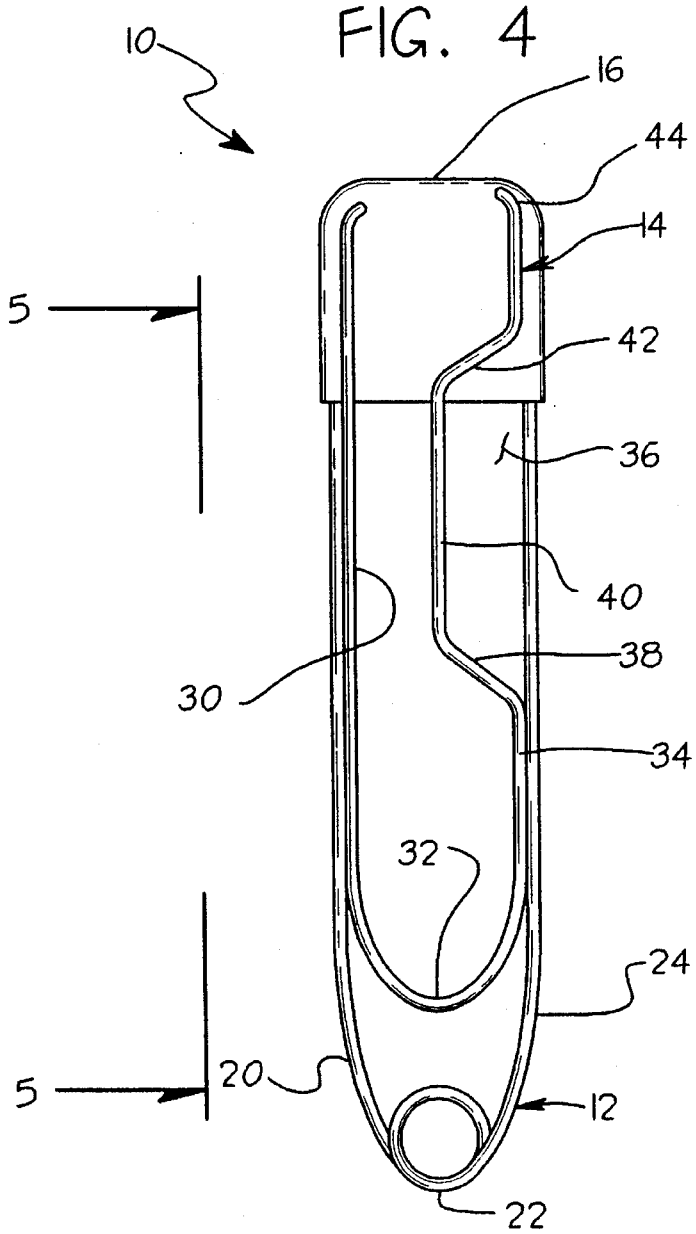
FIG. 4 is a rear elevation view of the invention, per se.
Figure 5:
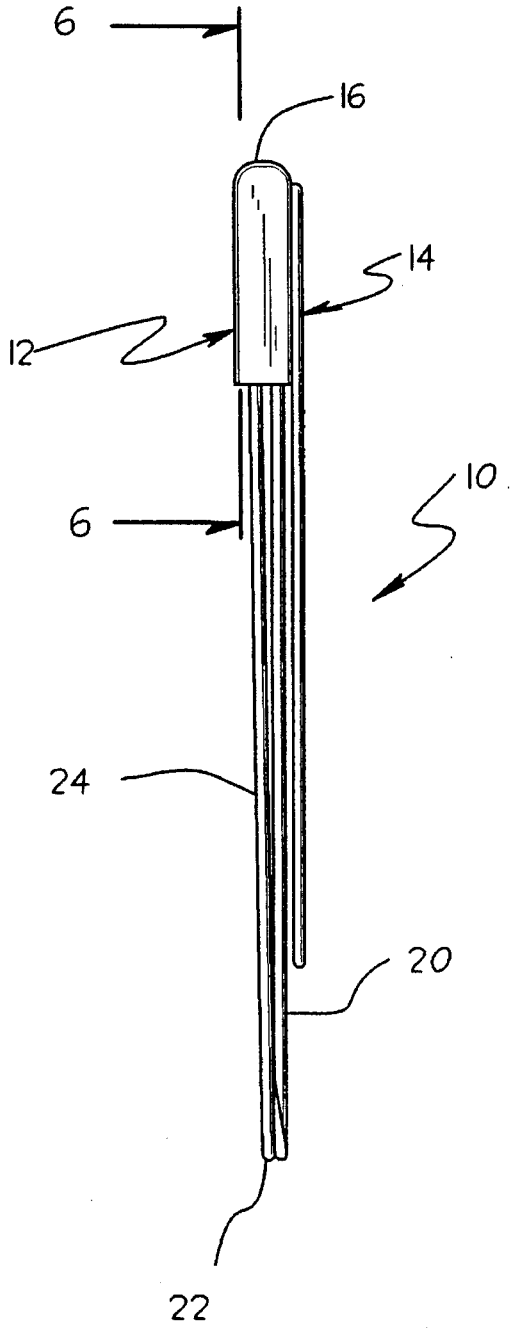
FIG. 5 is a side elevation view thereof.

Referring now to FIGS. 3 through 6 wherein a remainder of the present invention 10 is illustrated in detail, it can be shown that the paper clip 14 of the present invention 10 can be utilized to couple one or more planar objects together, such as the paper webs 28 illustrated in FIG. 3 of the drawings. To this end, the paper clip 14 comprises a first member 30 projecting from the end cap 16 which extends substantially parallel to the fixed member 20 of the safety pin member 12. The first member 30 continues into an integral bend 32, with a second member 34 projecting from the integral bend and towards the end cap 16. The second member 34 is coupled to the end cap 16 at an upper end thereof and cooperates with the first member 30 and the integral bend 32 so as to define an elongated loop which cooperates with the safety pin member 12 so as to frictionally engage and retain planar objects therebetween. To permit for ease of operation of the pivoting member 24 of the safety pin member 12, the second member 34 of the paper clip 14 is shaped so as to define a finger notch 36 directed thereinto. To this end, the second member 34 is shaped so as to define a first offset member 38 extending towards the first member 30 and continuing into a connecting member 40. The connecting member 40 continues in a substantially spaced and parallel orientation relative to the first member 30 and into a second offset member 42. The second offset member 42 is configured to extend away from the first member 30 and continues into an end member 44 defining the upper end of the second member 34 as viewed within FIG. 4. The end member 44 is coupled to the end cap 16 so as to secure the paper clip 14 relative thereto. By this structure, an individual placing a digit of a human hand onto an exterior of the pivoting member 24 can subsequently bias the pivoting member 24 against a force of the spring 22 and into the finger notch 36 to release the pivoting member 24 from the receiving slot 18 of the end cap 16.

Figure 6:
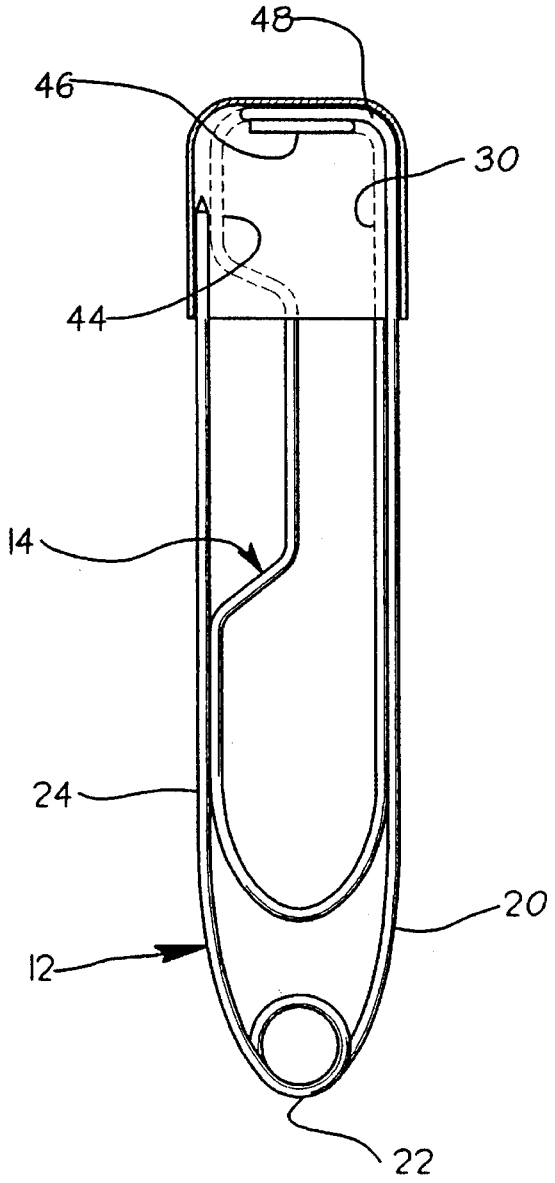
FIG. 6 is a cross-sectional view taken along line 6—6 of FIG. 5.

As shown in FIG. 6, the first member 30 of the paper clip 14 is preferably anchored to the end cap 16 by extending therethrough and terminating in an anchor section 46 which is crimped or otherwise secured within the end cap. Similarly, the end member 44 of the second member 34 of the paper clip 14 preferably projects through the end cap 16 to define a second anchor section 48 which is also crimped or otherwise secured within the end cap 16. Preferably, the second anchor section 48 integrally continues into the fixed member 20 of the safety pin member 12. By this structure, the members 20–24 of the safety pin member 12 and the members 30–48 of the paper clip 14 can be integrally formed from a single length of resilient wire.

In use, the paper clip safety pin 10 of the present invention can be easily utilized for securing a plurality of objects together by piercing or frictional engagement. The present invention 10 thus conveniently provides an end user with a choice of desired securing means during coupling of a plurality of objects together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paper clip safety pin comprising:

a safety pin member for piercingly engaging a plurality of objects so as to secure the objects together, the safety pin member comprises an end cap having a receiving slot directed thereinto; a fixed member extending from the end cap and continuing into a spring; a pivoting member extending from the spring and being biased thereby into the open position, the pivoting member being shaped so as to define a piercing tip, with the pivoting member being positionable against a force of the spring into the receiving slot of the end cap;

a paper clip extending from the safety pin member and cooperating therewith so as to frictionally engage and retain a plurality of planar objects between the paper clip and a portion of the safety pin member, the paper clip comprises a first member projecting from the end cap, the first member continuing an integral bend; a second member projecting from the integral bend and towards the end cap, the second member being coupled to the end cap and cooperating with the first member and the integral bend so as to define an elongated loop which cooperates with the safety pin member so as to frictionally engage and retain planar objects therebetween.

2. The paper clip safety pin of claim 1, wherein the second member of the paper clip is shaped so as to define a finger notch directed thereinto.

3. The paper clip safety pin of claim 2, wherein the second member is shaped so as to define a first offset member extending towards the first member and continuing into a connecting member, the connecting member extending in a substantially spaced and parallel orientation relative to the first member and continuing into a second offset member, the second offset member extending away from the first member and continuing into an end member, the end member being coupled to the end cap so as to secure the paper clip relative thereto.

4. The paper clip safety pin of claim 3, wherein the first member of the paper clip is anchored to the end cap by extending therethrough and terminating in an anchor section which is secured within the end cap.

5. The paper clip safety pin of claim 4, wherein the end member of the second member of the paper clip projects through the end cap to define a second anchor section secured within the end cap.

6. The paper clip safety pin of claim 5, wherein the second anchor section integrally continues into the fixed member of the safety pin member such that the members of the safety pin member and the members of the paper clip can be integrally formed from a single length of resilient wire.

* * * * *